US009096243B2

(12) United States Patent
Arnold

(10) Patent No.: US 9,096,243 B2
(45) Date of Patent: Aug. 4, 2015

(54) POINT DETECTOR OVERTIE STRUCTURE

(76) Inventor: James Arnold, Grass Valley, CA (US)

( * ) Notice: Subject to any disclaimer, the term of this patent is extended or adjusted under 35 U.S.C. 154(b) by 42 days.

(21) Appl. No.: 13/200,232

(22) Filed: Sep. 20, 2011

(65) Prior Publication Data

US 2013/0068897 A1 Mar. 21, 2013

(51) Int. Cl.
*E01B 7/02* (2006.01)
*B61L 5/10* (2006.01)

(52) U.S. Cl.
CPC .. *B61L 5/107* (2013.01); *E01B 7/02* (2013.01)

(58) Field of Classification Search
CPC ..... B61C 5/12; B61C 5/107
USPC ..... 246/220, 176, 253, 223, 476, 219, 260, 246/401, 448, 452, 449, 435 R, 450, 451, 246/453
See application file for complete search history.

(56) References Cited

U.S. PATENT DOCUMENTS

| | | | | | |
|---|---|---|---|---|---|
| 837,175 | A * | 11/1906 | Anderson | 238/292 |
| 2,533,929 | A * | 12/1950 | Gray et al. | 246/435 R |
| 2,785,835 | A * | 3/1957 | Brumfield | 246/453 |
| 4,093,163 | A * | 6/1978 | Larsson | 246/476 |
| 5,752,678 | A * | 5/1998 | Riley | 246/415 A |
| 6,158,698 | A | 12/2000 | Click et al. | |
| 7,168,662 | B1 * | 1/2007 | McQuistian et al. | 246/449 |

* cited by examiner

*Primary Examiner* — R. J. McCarry, Jr.
*Assistant Examiner* — Jean Charleston
(74) *Attorney, Agent, or Firm* — Theodore J. Bielen, Jr.

(57) ABSTRACT

A railroad switching apparatus utilizing a tie which is positioned under rails and points used in switching railroad cars. A support is interposed the tie and the rails and points and includes a passageway to guide the first and second indicator bars which are attached to the points. A slider is also employed at the attachment point of the indicator bars to the points to accommodate the thermal expansion and contraction of the rails and points. The indicator bars are formed into a coaxial unit in order to allow simple observation of the relative movement between the first and second indicator bars to determine proper movement of the points relative to the rails.

7 Claims, 5 Drawing Sheets

POINT DETECTOR OVERTIE STRUCTURE

BACKGROUND OF THE INVENTION

The present invention relates to a novel and useful railroad switching apparatus, using an over-the-tie structure.

Railway switches employ moveable rails or points which are associated with moveable indicator or detector rods. Such indicator rods are normally mechanically or electronically monitored in order to determine whether or not the points have properly traveled from one position to another in the switching operation. In addition, lock rods are employed to hold the points securely in place after they have switched positions. Further, a throw rod is also employed to apply forces which effect the mechanical switching.

In the past, indicator rods have been normally found adjacent to or between ties, either in a crib or on the railroad bed. Such cribs are normally located at or below the grade of the railway gravel bed. The absence of ballast around indicator rods found in such cribs provides access to the same, but the absence of ballast also causes lack of support and stability of the rails passing over the cribs. In addition, such crib structures prevent tamping of the ballast or gravel. Moreover, fouling of cribs or channels holding indicator or rods occurs over time.

In addition, thermal expansion and contraction of rails and movement of associated points tends to undermind the adjacent ties and requires special technique to tamp ballast in the near vicinity of such ties. Also, the thermal expansion and contraction of the rails and points often causes misalignment of the indicator rods and the detectors and may cause malfunction of controls used to determine the proper switching of the points.

Reference is made to U.S. Pat. No. 6,158,698 which shows a hollow tie switch assembly that employs U-shaped channels to confine indicator rods between connections to the points and the particular control and detection mechanism. However, such channels lie below grade and suffer many of the problems in the prior art in that the ballast used on track beds tends to foul and damage the indicator rods and the channels themselves.

A railroad track switching apparatus which overcomes the problems of the prior art and provides an unobstructed and accurate movement of the indicator rods connected to the rail points would be a notable advance in the railroad industry.

SUMMARY OF THE INVENTION

In accordance with the present invention a novel and useful railroad track switching apparatus which is compatible with the rails, points, and indicator rods or bars, found in railroad switching mechanisms is provided.

The railroad track switching apparatus of the present invention utilizes a tie that is sized to underlie and occupy space beneath the first and second moveable points and the respective associated first and second rails. The tie would extend above the grade of the bed underlying the rails, yet be firmly anchored to the bed. The tie may be formed of any material possessing substantial strength such as metal, and the like. Needless to say, the tie of the present invention would possess a different dimension from a normal railroad tie, which is being replaced by the tie of the present invention.

A support is also found in the present invention and is interposed the tie and the first and second moveable points and the respect associated first and second rails. The support is intended to provide contact with the rail above such that the rails position at the same height as provided by adjacent ties of conventional construction. The support includes a passageway which is capable of accommodating one or two of the point detector bars or indicator bars that run from the points lying against the rails. Thus, the indicator bars lie over the tie and below the rails and position a certain distance above the bed. Again, the support may be constructed of a relatively strong material such as metal.

A first fastener and a second fastener hold the first and second indicator bars, respectively, to the first and second moveable points, respectively. Thus, the first and second indicator bars accurately define the proper switching of the points by determination of the distance traveled by each of the indicator bars when such switching occurs.

The first and second fasteners may take the form of a pair of bases one of which is fixed to the first and second moveable points, respectively. Each base includes a channel and a slider which runs or travels in the channel. The indicator bars are then connected to the sliders such that thermal contraction or expansion of the rails and points maintains the indicator bars in a relatively steady position above the tie. Each of the sliders are held, by a bracket, within the channel of the base. The bracket is supported to the point which lies above the tie.

The first and second indicator bars are oriented substantially at right angles to the rails and are shunted from the rails to a detector control which includes conventional device for metering for the relative movement of the indicator bars and, thus, determining the proper switching of the points. Of course, should the indicator bars show that an improper switching of points has taken place, a signal will be generated to stop traffic on the rails until the problem is solved. As a opposed to conventional side by side observance of movement of the indicator bars, the present invention provides for a co-axial orientation of the indicator bars by providing a hollow sleeve which is linked to the first indicator bar for movement therewith. Likewise, a rod is linked to the second indicator bar for movement, therewith, and passes through the hollow sleeve such that it extends therefrom. Thus, the rod and sleeve are independently moveable relative to one another. Again, such relative movement may be measured to determine the proper switching of the points and permits the conventional generation of a signal base on improper or proper switching of the points.

It may be apparent that a novel and useful railroad track switching apparatus has been hereinabove described.

It is therefore an object of the present invention to provide a railroad track switching apparatus which provides for a tie and support that allows the indicator bars connected to the points of the switching mechanism to lie above the bed of the rails and above the tie provided.

Another object of the present invention is to provide a railroad track switching apparatus that quickly and easily determines and improper switching of the point or a broken point and permits the generation of an alarm signal in accordance with such determination.

Another object of the present invention is to provide a railroad track switching apparatus which permits the steady positioning of the indicator rods even during thermal expansion or contraction of the rails and points, and provides an accurate determination of improper switching of the points.

Another object of the present invention is to provide a railroad track switching apparatus which reveals the relative movements of a pair of points in a single co-axial arrangement.

A further object of the present invention is to provide a railroad track switching apparatus which prevents potential damage to the indicator rods due to interaction with the ballast of the railroad bed.

A further object of the present invention is to provide a railroad track switching apparatus which allows proper tamping of the ballast of the railroad bed without damage to the indicator rods and throw rods.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
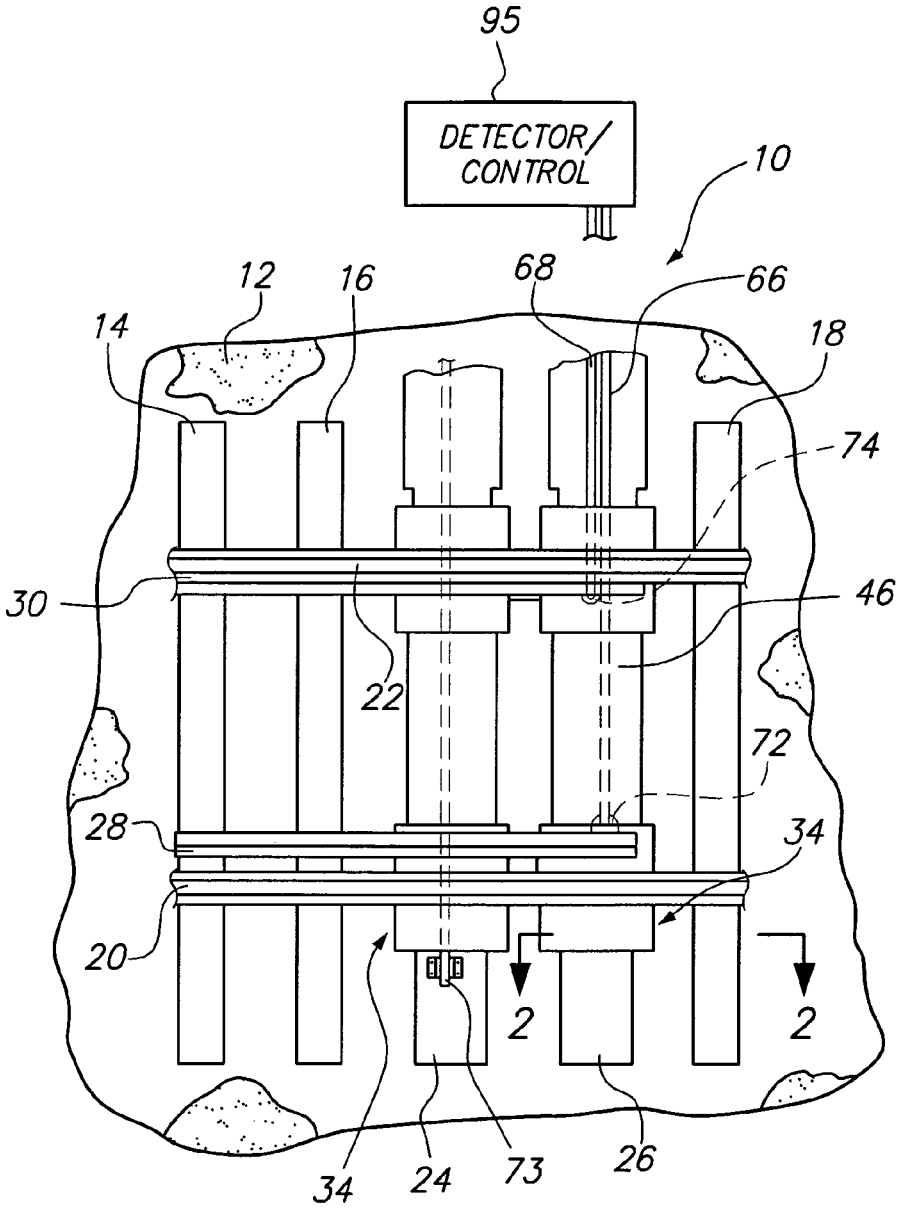
FIG. 1 is a schematic top plan view of the apparatus of the present invention in place relative to a pair of rails adjacent conventional ties.+
Figure 6:
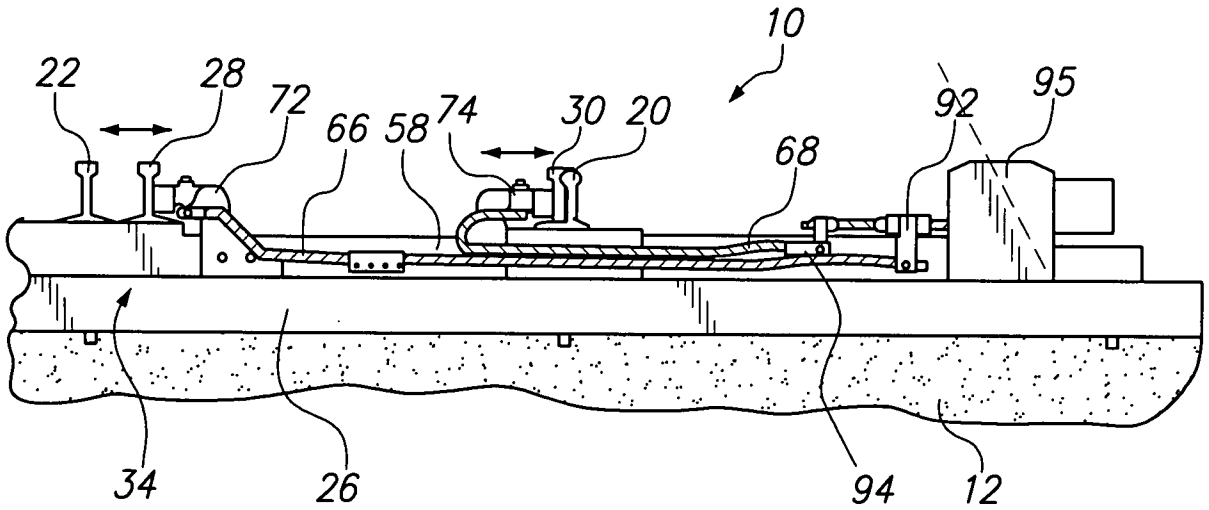
FIG. 6 is a side elevational view of the railroad track switching apparatus of the present invention depicting the indicator bars or rods in hatched configuration for the sake of clarity.

An embodiment of the invention as a whole is depicted in the drawing by reference character 10, FIGS. 1 and 6, in particular. With reference to FIG. 1, it may be observed that a ballast railroad bed 12 supports conventional ties 14, 16, and 18. Rails 20 and 22 are in turn supported by ties 14, 16, and 18. Bed 12 ballast is usually composed of gravel or other aggregate material which requires tamping to maintain the stability of bed 12. Also, depicted in FIG. 1, are ties 24 and 26 which form part of the apparatus 10 of the present invention. Further, moveable points or rails 28 and 30 are shown in relation to rails 20 and 22. As heretofore described, points 28 and 30 are employed in the switching of railroad cars on rails 20 and 22.

Figure 2:
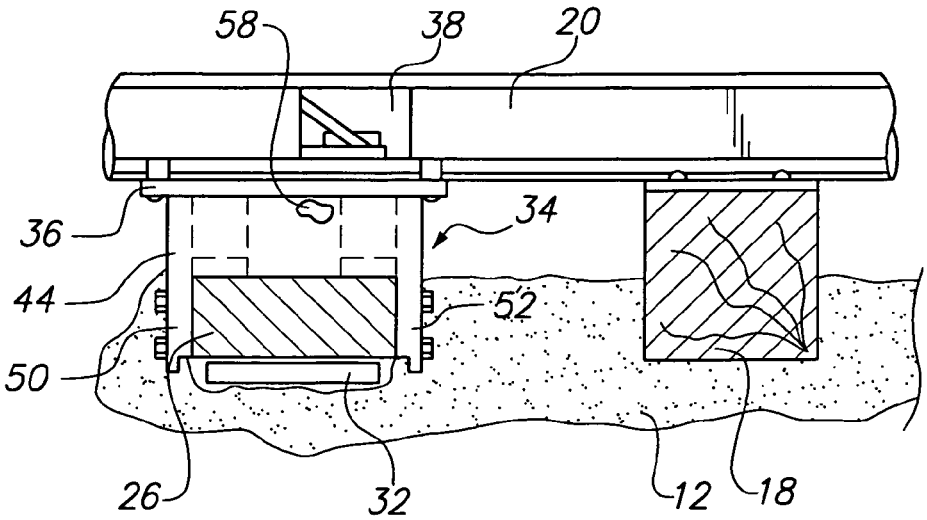
FIG. 2 is a sectional view taken along line 2-2 of FIG. 1.

Referring now to FIG. 2, it may be observed that tie 26 of the present invention possesses a different configuration from conventional tie 18 of the prior art. Conventional tie 18 is normally composed of treated wood or concrete and is approximately 25 centimeters by 25 centimeters in section. In contrast, tie 26 of the present invention is composed of metallic material and is approximately 30 centimeters in width and 13 centimeters in height, in section. In addition, tie 26 may include a multiplicity of cleats, such as cleat 32, to aid in the stability of tie 26 relative to bed 12.

Figure 3:
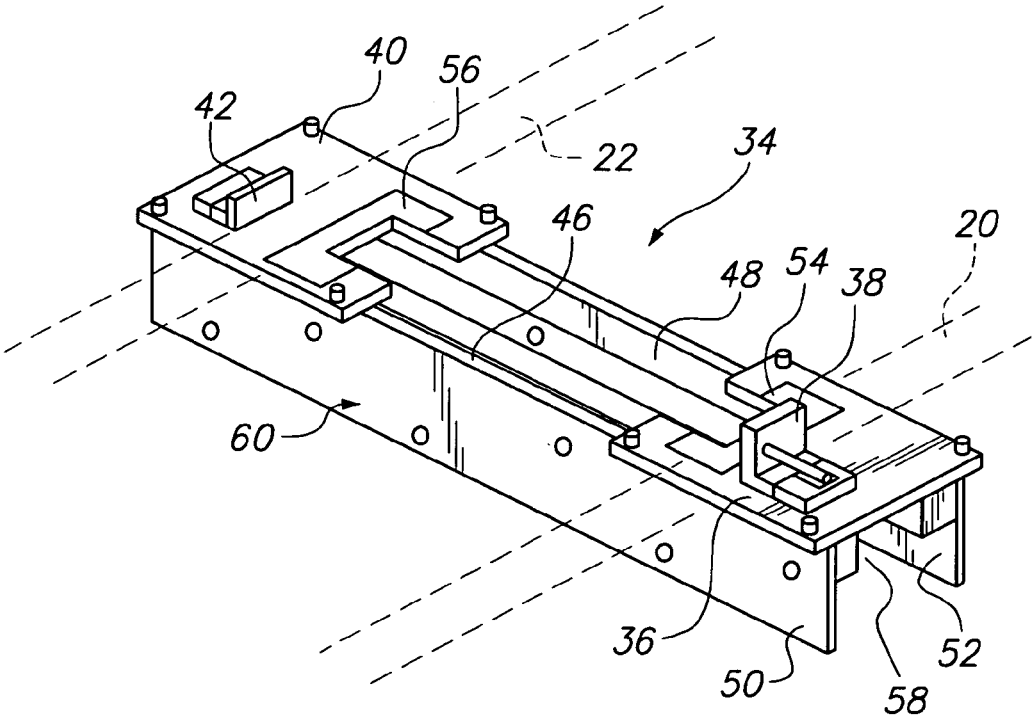
FIG. 3 is a top right end perspective view of the support of the present invention with a pair of rails shown in phantom.

Turning to FIG. 3, and with further reference to FIG. 2, it may be seen that a support or riser block or wall 34 is also employed in conjunction with ties 24 and 26. Namely, support 34 is employed to interpose ties 24 and 26 and rails 20 and 22. With respect to support 34 that interposes tie 26 and rail 20, FIG. 2, it may be apparent that support 34 includes an upper plate which is employed to serve as a base for rail holder 38, which may be of conventional configuration. Plate 40 and holder 42 are employed with the respect to rail 22, FIG. 3, and are identical to plate 36 and holder 38 used to stabilize rail 20. Support 34 includes an end cover 44 which is used on either end of support 34. The rendition of support 34 depicted in FIG. 3 shows a cover 44 being removed as well as top cover 46, FIG. 1 for the sake of revealing the interior portion of support 34. Structural members 46 and 48 are attached to side covers 50 and 52 to provide rigidity to support 34. Support 34 also includes U-shaped wear plates or reinforcements 54 and 56, FIG. 3. It should be noted that support 34 forms a passageway 58, the purpose in which will be discussed hereinafter. Structural members 46 and 48 may be held to side covers 50 and 52 by welding or by the use of through-bolts, which is represented schematically by plurality of circles 60 on FIG. 3.

The apparatus of the present invention is intended to be employed in conjunction with first indicator bar 66 and second indicator bar 68. First indicator bar 66 is used in association with point 28 while second indicator bar 68 is employed in conjunction with point 30. First fastener 72 links first indicator bar 66 to point 28. Second fastener 74, likewise, links second indicator bar 68 to point 30. Fasteners 72 and 74 are depicted schematically on FIGS. 1 and 2 and in detail in FIGS. 4 and 5.

Tie 24 and support 30 are used in conjunction with throw rod 73 which extends through a passageway 58 similar to the passageway 58 found in the vicinity of tie 26.

Figure 4:
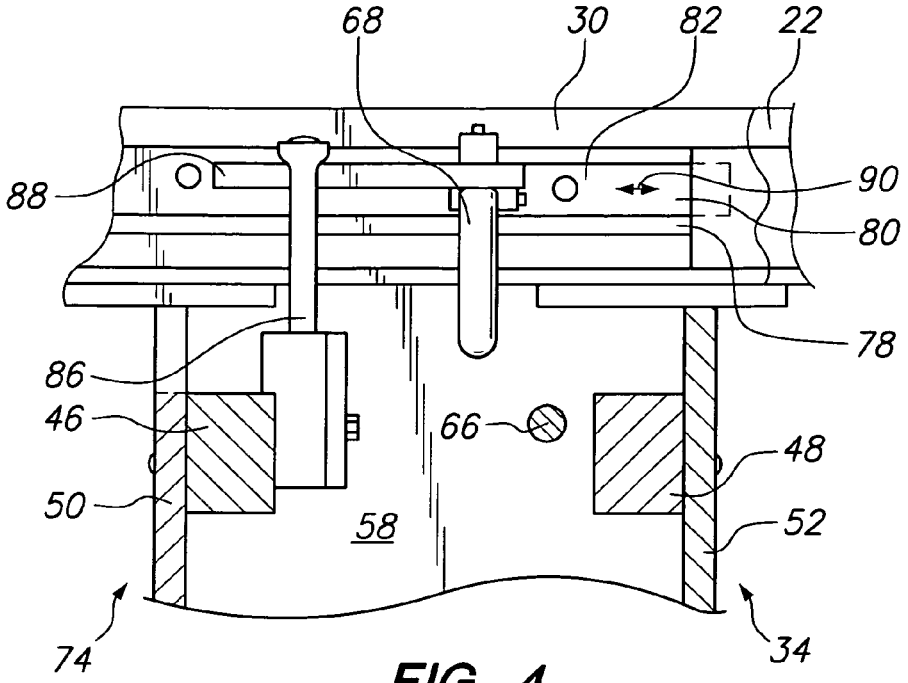
FIG. 4 is a side view of the slider fastener mechanism with the support depicted in section.
Figure 5:
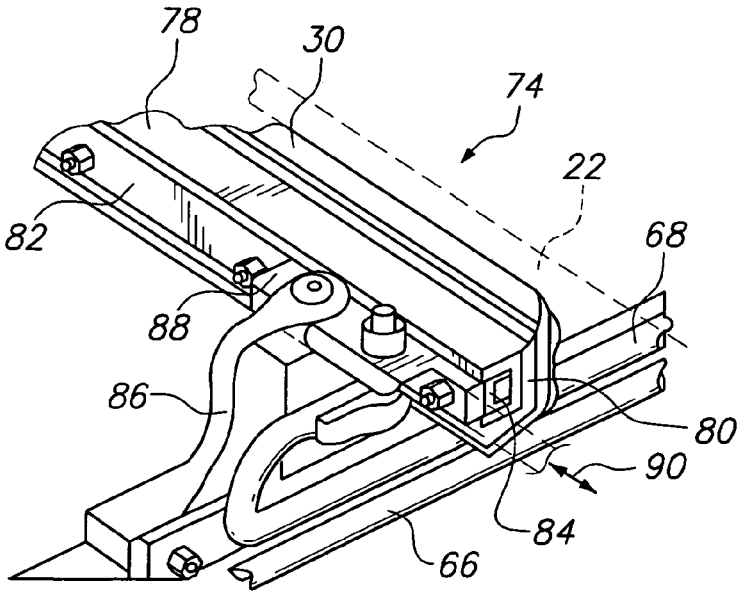
FIG. 5 is a top right perspective view of the slider fastener or mechanism depicted in FIG. 4.

Turning now to FIGS. 4 and 5, fastener 74 is depicted in detail. It should be realized that the structure of fastener 74 is identical to the structure of fastener 72, which links first indicator bar 66 to point 28. It may be observed, on FIG. 4, that first indicator bar 66 and second indicator bar 68 extend at least through a portion of passageway 58 of support 34. Fastener 74 is intended to accommodate the thermal expansion and contraction of rail 22 and point 30 in order to stabilize the position of second indicator bar 68. Again, it may be realized that first indicator bar 66 is also stabilized by the use of fastener 72, of similar construction to fastener 74. It may also be seen that first indicator bar 66 and second indicator bar 68 pass over tie 26 and under rail 22 and point 28, above the grade of bed 12. Fastener 74 is provided with a base 78 which is fastened to point 30 by the Use of fasteners, welding, gluing, or the like. Base 78 is under rail 22 and point 28, above the grade of bed 12. Fastener 74 is provided with a base 78 which is fastened to point 30 by the use of fasteners, welding, gluing, or the like. Base 78 is provided with a channel 80. A slider 82 is configured to run along channel 80 and has a backing member 84. Bracket 86 is fixed to slider 82 via flange 88. Bracket 86 is itself anchored to structural member 46 against wall 50 of support 34. Thus, slider 82, via flange 88, holds second indicator bar 68 in a steady position should rail 22 and point 30 move due to thermal expansion and/or contraction. A similar slider steadies first indicator bar 66 with respect to point 28 and rail 20. In other words, slider 82 moves along channel 80 when such rail 22 and point 30 thermal expansion or contraction takes place according to directional arrow 90. Thus, first indicator bar 66 and second indicator bar 68 are not bent or distorted when thermal expansion or contraction takes place with respect to rail 22 and point 28. Again, the same holds true with respect to first fastener 72 and rail 20 and point 28.

Figure 7:
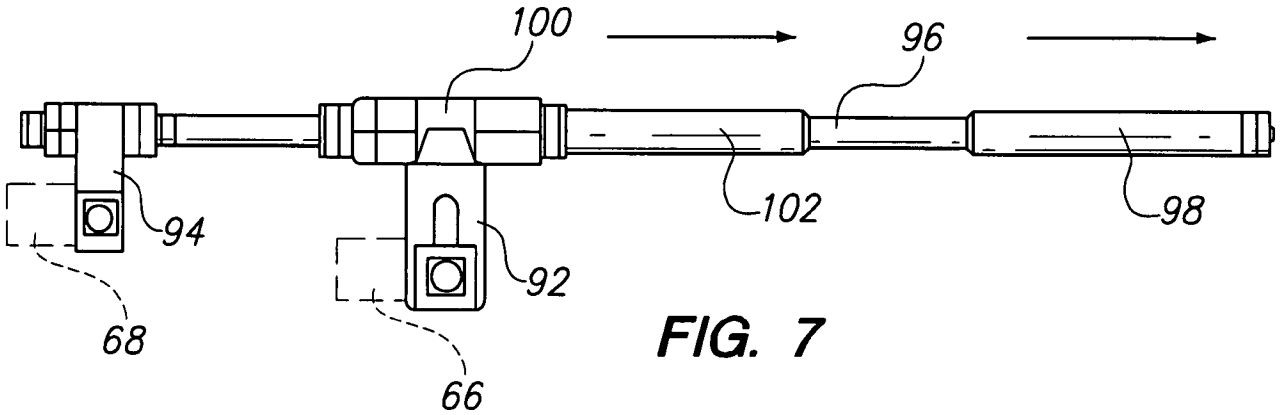
FIG. 7 is a partial side elevational view of the co-axial arrangement of the two indicator bars used for dual point indication, in normal movement.
Figure 8:
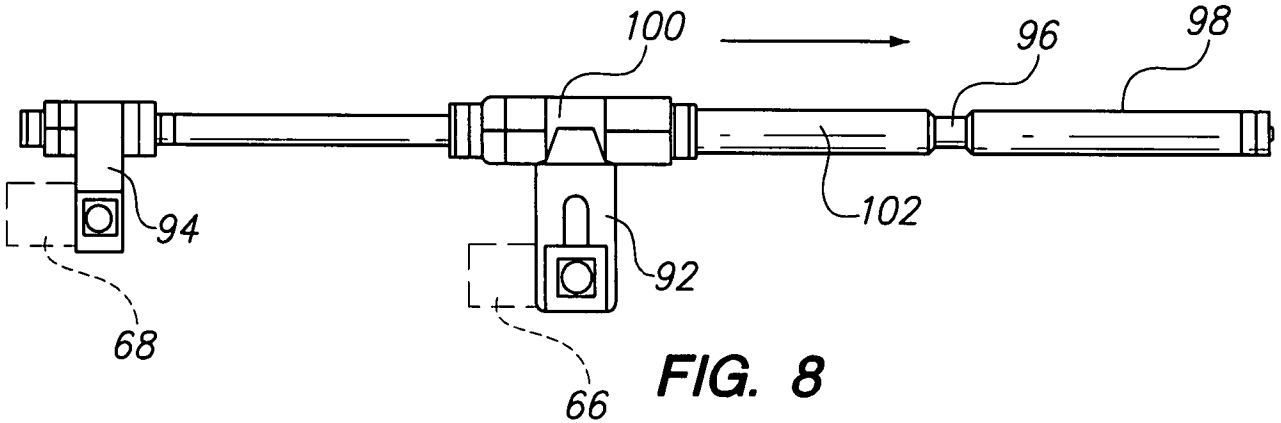
FIG. 8 is a side elevational view of a pair of co-axially arranged point indicator bars depicting a failure of a point switching.

In operation, looking now at FIGS. 6, 7, and 8, it may be observed that dual point detection is achieved in the present invention in a very efficient manner. FIG. 6 shows support 34 in an open configuration to reveal point detector bars 66 and 68 between points 28 and 30, respectively. First point detector or indicator bar 66 is held by a drop lug 92, while second point detector bar 68 terminates a drop lug 94. Detection control unit 96, of known configuration, is capable of observing the relative movement between first detector bar 66 and second detector bar 68 to determine a proper switching of either point 28 or point 30. Drop lug 94 connects to a rod 96 having an enlarged end 98. Thus, the movement of rod 96 indicates the movement of second indicator bar 68 and point 30. First drop lug 92 is fixed to a sleeve 100. Rod 96 passes through sleeve 100 and moves freely relative to sleeve 100. Rod 96 and sleeve 100 are generally co-axial. Sleeve 100 includes enlarged portion 102. Again, the motion of sleeve 100 indicates the movement of first indicator bar 66 and point 28. FIG. 7 shows a normal movement of points 28 and 30 and indicator bars 66 and 68, respectively, during a switching operation relative to rails 20 and 22. On the other hand, FIG. 8 shows the disparate movement between sleeve 100 and rod 96 and, thus, indicator bars 66 and 68, respectively. Such a relative position between sleeve 100 and rod 96 shows a broken point or an improper movement of a point. Conventional detector/control 95 would be capable of realizing proper movement shown in FIG. 7 of indicator rod 66 and indicator rod 68, as well as the improper movement of indicator rod 66 and 68 shown in FIG. 8. Of course, a conventional signal would be generated based on such determination by detector/control 95.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A railroad track switching apparatus for use with a railroad track system having first and second rails and first and second indicator bars associated with respective first and second moveable points, each of the first and second rails and each of the first and second points possessing a longitudinal dimension, the first and second moveable points being associated with first and second rails, respectively comprising:

a. a tie, said tie sized to space from the first and second moveable points and the respective associated first and second rails;

b. a support, said support interposed said tie and the first and second moveable points and the respective associated first and second rails, said support accommodating the positioning of the first and second indicator bars between said tie and at least one of the first and second rails;

c. a first fastener for holding the first indicator bar relative to the first moveable point for traveling therewith during track switching, and a second fastener for holding the second indicator bar to the second moveable point for traveling therewith during track switching, said first fastener comprising a base fixed to the first moveable point, said base including a channel and a slider, said slider traveling relative to said channel of said base in a direction along the longitudinal dimension of the first rail associated with the first moveable point, upon the thermal expansion or contraction of the first rail, the first indicator bar being connected to said first slider, said first slider being linked to said support.

2. The apparatus of claim 1 in which said base comprises a first base and said slider comprises a first slider, and further in which said second fastener comprises a second base fixed to the second moveable point, said second base including a channel and a second slider, said second slider traveling relative to said channel of said second base in a direction along the longitudinal dimension of the second rail associated with the second moveable point, upon the thermal expansion or contraction of the second rail, the second indicator bar being connected to said second slider.

3. The apparatus of claim 2 which additionally comprises a first bracket linked to said support, said first bracket being fixed to said first slider.

4. The apparatus of claim 3 which additionally comprises a second bracket linked to said support, said second bracket being fixed to said second slider.

5. The apparatus of claim 1 which further comprises:

a. a hollow sleeve, said hollow sleeve being linked to the first indicator bar for movement therewith;

b. a rod, said rod being linked to the second indicator bar for movement therewith, said rod passing through said hollow sleeve and extending therefrom, said rod being independently activated relative to said sleeve linked to the first indicator bar for movement therewith.

6. The device of claim 1 in which said tie is sized to underlie the first and second moveable points and the respective associated first and second rails, respectively.

7. The device of claim 1 in which said support includes a passageway to accommodate positioning of the first and second indicator bars between said tie and at least one of the first and second rails.

* * * * *